United States Patent [19]

Warmbold

[11] 4,248,279

[45] Feb. 3, 1981

[54] TAMPER RESISTANT FUEL FILLER RESTRICTOR ASSEMBLY

[75] Inventor: Helmut Warmbold, Sterling Hgts., Mich.

[73] Assignee: Chrysler Corporation, Highland Park, Mich.

[21] Appl. No.: 35,676

[22] Filed: May 3, 1979

[51] Int. Cl.[3] ..... B67C 3/34

[52] U.S. Cl. ..... 141/348; 141/326; 220/86 R; 251/149.2

[58] Field of Search ..... 141/392, 346–362, 141/286, 331, 335, 344, 311 R; 220/35, 36, 86 R, 86 AT; 251/149.2, 339; 137/351, 588, 592; 280/5 A; 296/1 C

[56] References Cited

U.S. PATENT DOCUMENTS 3,911,977 10/1975 Berger ..... 141/348

*Primary Examiner*—Houston S. Bell, Jr.

*Attorney, Agent, or Firm*—Newtson & Dundas

[57] ABSTRACT

An improved fuel filler restrictor assembly includes a reinforcing member adjacent the aperture through which a fuel filling nozzle is inserted. The reinforcing member is secured to the filler neck restrictor body by integral tabs and has projections extending radially inwardly beyond the minimum outer diameter of an unleaded fuel pump delivery nozzle. Restrictor tampering to permit unlawful use of leaded fuel is thereby inhibited.

7 Claims, 3 Drawing Figures

TAMPER RESISTANT FUEL FILLER RESTRICTOR ASSEMBLY

BACKGROUND OF THE INVENTION

1. Field of Invention

The present invention relates generally to automotive fuel tank filler tubes and more specifically to restrictor assemblies therefor.

2. Description of the Prior Art

With the introduction of catalytic converters for treating the exhaust gases of internal combustion engines, Federal standards were promulgated which were intended to inhibit the filling of fuel tanks of automobiles equipped with such converters with leaded fuel, since use of leaded fuel renders the catalytic converters permanently ineffective. Among these standards is one limiting the amount of leaded fuel that could be delivered to the tank of a converter equipped automobile before the automatic shut-off mechanism of a filling station nozzle actuates to block flow to 700 cubic centimeters of fuel. Another companion standard provides that the delivery nozzles for unleaded fuel shall not exceed 0.85 inch in diameter while delivery nozzles for leaded fuel shall not be less than 0.93 inch in diameter.

One automotive industry response to these standards has been to install restrictor assemblies in the fuel filler tube having a spring loaded door closing an aperture sized to permit insertion of only an "unleaded nozzle" for opening the door. U.S. Pat. No. 4,034,784 and application Ser. No. 899,685, filed Apr. 24, 1978, now U.S. Pat. No. 4,185,844, assigned to the assignee of the present invention, are exemplary of such assemblies.

It has been noted, however, that the economic pressure of the higher cost of unleaded fuel has resulted in the owners of converter equipped automobiles modifying the restrictor assemblies through enlarging the aperture to permit the use of leaded fuels. This, of course, tends to defeat the above mentioned Federal standards.

It has been suggested that some reinforcing means, such as a simple washer adjacent the aperture, be employed in the restrictor assemblies to inhibit the enlarging modification; but none yet suggested have been effective.

SUMMARY OF THE INVENTION

Responsive to the deficiencies of the prior art restrictor assemblies, it is an object of the present invention to provide a restrictor assembly configured to greatly inhibit modification required to permit insertion of a leaded fuel delivery nozzle.

According to a feature of the present invention, a hardened reinforcing member having projections for preventing nozzle insertion is secured to a portion of the restrictor assembly about its nozzle receiving aperture in a manner that tends to require its complete disassembly to effect aperture enlarging modification of the restrictor assembly.

BRIEF DESCRIPTION OF THE DRAWINGS

These and other objects and features will become apparent to those skilled in the art upon reading the following detailed description with reference to the accompanying drawing in which.

DESCRIPTION OF THE PREFERRED EMBODIMENT

Figure 2:
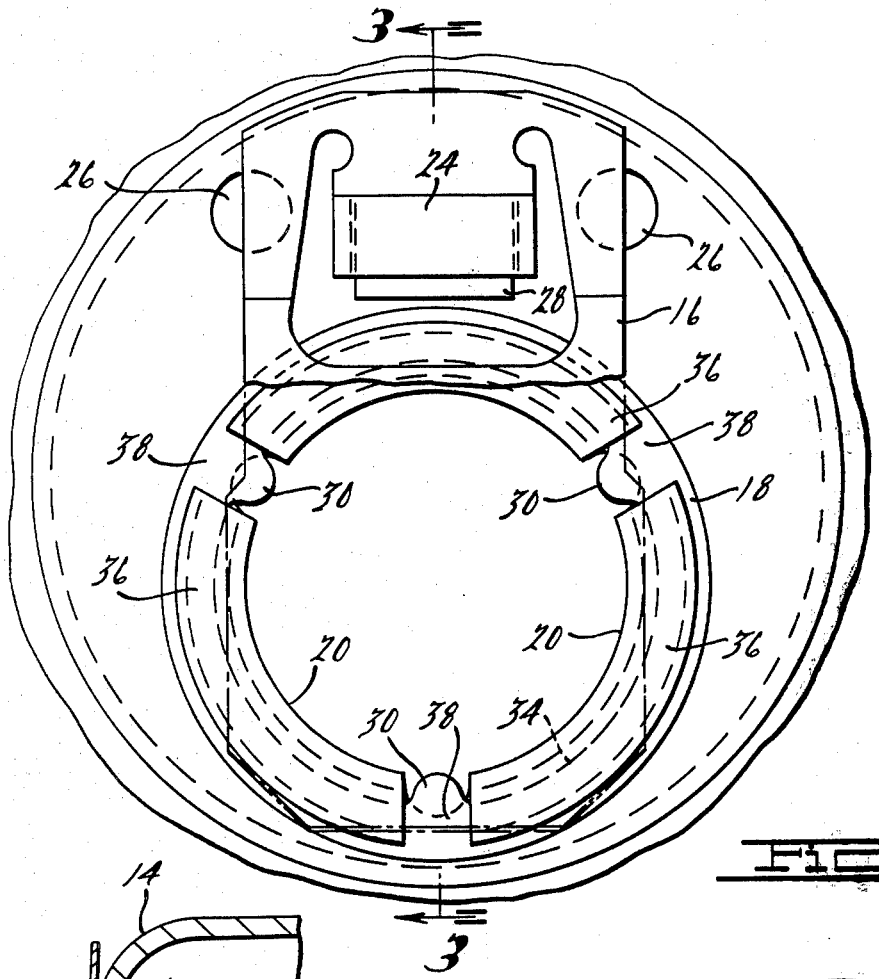
FIG. 2 is an enlarged rear end view of the invention restrictor assembly, certain parts broken away for clarity.
Figure 3:
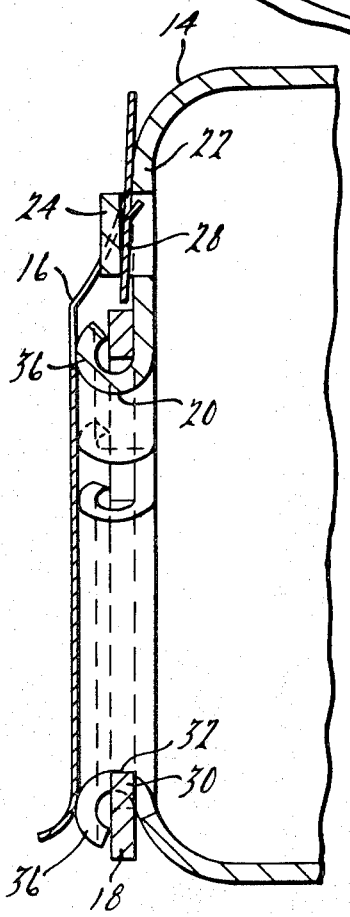
FIG. 3 is a cross sectional view taken along line 3—3 of FIG. 2.
Figure 1:
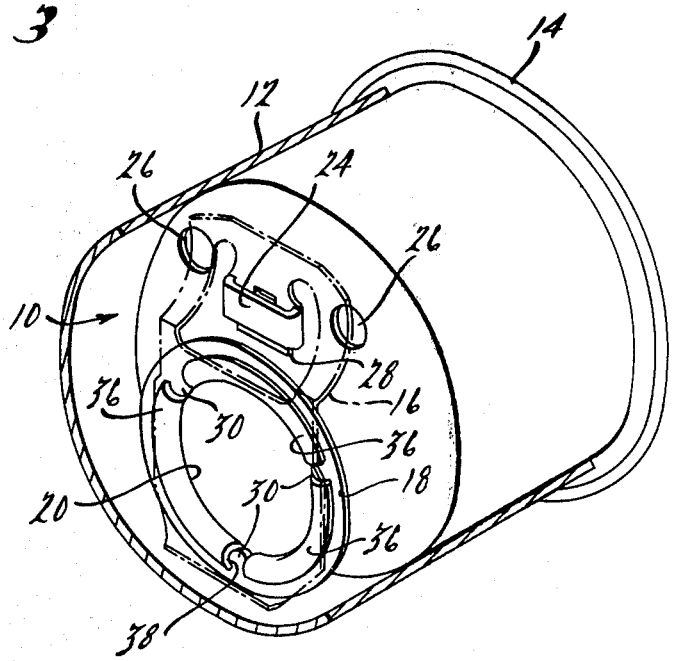
FIG. 1 is a perspective view of the restrictor assembly of the present invention installed in a fuel tank filler tube.

Turning now to the drawing, and in particular to FIG. 1 thereof, a restrictor assembly 10 is illustrated as being installed in the outer end of a fuel filler tube 12. It is well known in the art that such filler tubes are normally joined to a convenient automotive body panel adjacent the outer end and are inserted into the vehicle's fuel tank. It is felt that this mounting arrangement is so well known to those skilled in the art that no further description or illustration is necessary.

The invention restrictor assembly 10 is illustrated as generally comprising a cup-shaped body member 14 to which are secured a restrictor door member 16 and a reinforcing member 18.

The body member 14 is preferably formed as an elongated formable sheetmetal member that may be secured, as by welding, within the filler tube and includes an axially extending fuel nozzle receiving aperture 20 (to be later more fully described) formed through its inner wall 22 and a tab receiving slot 24 formed, as by stamping, through the same wall 22. Vent holes 26 are also preferably formed through the wall 22 to facilitate filling.

The restrictor door member 16 is preferably a resilient metallic member of known design and includes a tab portion 28 received in the slot 24 whereby it is fixed to the body member 14 in a position normally effecting closure of the fuel nozzle receiving aperture 20.

The aperture 20 is sized to permit the insertion of fuel delivery nozzles for unleaded fuel (which nozzles may not exceed 0.85 inch in diameter) to displace the restrictor door member 16 and permit filling the vehicle fuel tank. It is further sized to prevent such insertion of fuel delivery nozzles for leaded fuel (which nozzles may not be less than 0.93 inch in diameter). This sizing is accomplished through the cooperation of the body member 14 and the reinforcing member 16 which it is formed to retain.

The reinforcing member 16 is preferably formed as a ring from metal which exhibits a hardness in at least the range of Rc 58–62. It includes a plurality of radially inwardly extending circumferentially spaced projections 30 which define a hardened limiting diameter indicated at 32 for the fuel nozzle receiving aperture 20. An inner diametral surface 34 of the reinforcing member 18 is sized so that circumferentially arrayed portions 36 of the inner wall 22 of body member 14, which are spaced by radially extending slots 38 registering with the projections 30, may be mechanically formed to retain the reinforcing member 18 while defining the remainder of the aperture 20 between the projections 30. Since the inner diametral surface 34 and the thickness of the inner wall 22 of the body member 14 are chosen so that the hardened surface 34 is less than the 0.93 inch minimum diameter of leaded fuel nozzles, it should be clear that modification of the invention restrictor assembly 10 to permit unwanted filling of vehicle fuel tanks with leaded fuel is severely hampered. Hardened projections 30 are presented to prevent the unwanted insertion; and these projections can only be removed to a diameter greater than that of a leaded fuel nozzle by the complete removal of the reinforcing member 18, which would require removal of the filler tube 12 if debris is to be kept from the fuel tank.

While only one embodiment has been described, others may be possible without departing from the scope of the appended claims.

What is claimed is:

1. A restrictor assembly for a fuel tank filler tube for preventing filling the fuel tank of a vehicle with a leaded fuel nozzle of a known diameter and permitting filling the fuel tank with an unleaded fuel nozzle of a smaller known diameter comprising:

A. a cup-shaped housing member fabricated from a readily formable material and fixedly secured to the filler tube adjacent the end thereof remote from the fuel tank;

B. means defining an aperture through said housing member parallel to the axis of the filler tube;

C. closure means carried on said housing member and movable between a normal position substantially blocking said aperture and a fill position opening said aperture; and D. reinforcing means fixedly secured to said housing member adjacent said closure means, and including a plurality of circumferentially spaced projections extending radially inward within said aperture to define a circular plane of larger diameter than the unleaded fuel nozzle diameter and of smaller diameter than the leaded fuel nozzle diameter to permit movement of said closure means to said fill position and filling of the tank by insertion of the unleaded fuel nozzle and to prevent insertion of the leaded fuel nozzle to effect movement of said closure means to said fill position.

2. A restrictor assembly as defined in claim 1 wherein said reinforcing means is formed of a hardened material having a hardness number of at least 58 on the Rockwell C scale.

3. A restrictor assembly as defined in claims 1 or 2 wherein said reinforcing means further includes a hardened diametral surface circumferentially spacing said projections and being of smaller diameter than the leaded fuel nozzle.

4. A restrictor assembly as defined in claims 1, 2 or 3 wherein said reinforcing means comprises a generally ring-shaped member and said housing member includes a plurality of radially extending tabs adjacent the periphery of said aperture and interdigitated with said reinforcing means projections, said tabs being formed about said reinforcing means to secure said reinforcing means to said housing member about said aperture.

5. A restrictor assembly for a fuel tank filler tube for preventing filling the fuel tank with a leaded fuel nozzle of a known diameter and permitting filling the fuel tank with an unleaded fuel nozzle of a smaller known diameter comprising:

A. a cup-shaped housing member formed of a ductile material and fixedly secured to the filler tube adjacent the outer end thereof remote from the fuel tank;

B. means defining an aperture through said housing member along the axis of the filler tube;

C. a door member carried by said housing member for pivotal movement with respect thereto between a position substantially blocking said aperture and positions opening said aperture;

D. a ring-shaped reinforcing member positioned adjacent said aperture, and having a plurality of peripherally spaced projections extending radially inwardly to positions defining a circular plane of larger diameter than the unleaded fuel nozzle diameter and of smaller diameter than the leaded fuel nozzle diameter, thereby preventing engagement of said leaded fuel nozzle with said door member and permitting engagement of said unleaded fuel nozzle with said door member to allow opening said aperture upon insertion of said unleaded fuel nozzle; and E. means defining a plurality of peripherally spaced tabs in said housing member adjacent said aperture crimpingly formed in interdigitated relationship with said reinforcing member projections to axially and radially secure said reinforcing member to said housing member.

6. A restrictor assembly as defined in claim 4 wherein said reinforcing member is formed of a hardened material having a hardness number of at least 58 on the Rockwell C scale.

7. A restrictor assembly as defined in claim 5 wherein said ring-shaped reinforcing member further includes a hardened diametral surface circumferentially spacing said projections and being of smaller diameter than the leaded fuel nozzle.

* * * * *